United States Patent [19]

Krotkiewicz et al.

[11] 4,379,031

[45] Apr. 5, 1983

[54] EVAPORATION DRIVEN COUNTERFLOW RINSE SYSTEM AND METHOD

[75] Inventors: James A. Krotkiewicz, Elyria; Wayne A. Kruper, Willowick; Otto C. Niederer, Madison, all of Ohio

[73] Assignee: Imperial Clevite Inc., Rolling Meadows, Ill.

[21] Appl. No.: 225,709

[22] Filed: Jan. 16, 1981

[51] Int. Cl.[3] ..... C25D 17/02

[52] U.S. Cl. ..... 204/45 R; 118/429; 134/10; 134/26; 134/61; 204/35 R; 204/194; 204/237

[58] Field of Search ..... 134/60, 10, 12, 26; 204/35 R, 45 R, 194, 237; 118/429; 427/345

[56] References Cited

U.S. PATENT DOCUMENTS

| | | | |
|---|---|---|---|
| 2,721,562 | 10/1955 | Irvine | 134/60 |
| 2,845,936 | 8/1958 | Boynton et al. | 134/60 |
| 3,542,651 | 11/1970 | Yagishita | 204/237 X |
| 3,681,212 | 8/1972 | McKissick | 204/45 R X |

*Primary Examiner*—G. L. Kaplan
*Attorney, Agent, or Firm*—Russell E. Baumann

[57] ABSTRACT

An electroplating apparatus comprises a plating tank, first, intermediate, and final rinse tanks, and a plurality of weirs which connect the plating tank and the first rinse tank, the first and intermediate rinse tanks, and the intermediate and final rinse tanks. The plating tank is filled to a predetermined level with a plating solution including plating chemicals and water. The rinse tanks are each filled to the predetermined level with rinse solution including water and plating chemicals which have been rinsed from preceding workpieces. The final rinse tank has an overflow outlet at the predetermined level and receives a continuous flow of water. As water evaporates from the plating tank, rinse solution flows by gravity through the connecting weir to the plating tank to replace it. Similarly, rinse solution flows by gravity through the connecting weir from the intermediate rinse tank to the first rinse tank and flows by gravity through the connecting weir from the final rinse tank to the intermediate rinse tank. The continuous flow of water into the final rinse tank replaces the solution flowing by gravity to the intermediate rinse tank thus maintaining the plating and rinse tanks at the predetermined level. To prevent plating chemicals from migrating from more concentrated solutions to less concentrated solutions, baffles are placed in each of the weirs. The baffles render the flow paths sufficiently long and tortuous so that the evaporation replacing flow offsets the migration of plating chemicals toward less concentrated solutions.

13 Claims, 2 Drawing Figures

EVAPORATION DRIVEN COUNTERFLOW RINSE SYSTEM AND METHOD

BACKGROUND OF THE INVENTION

This application pertains to the art of chemical or effluent recovery in chemical or electrochemical treatment apparatus and methods. The invention finds particular application in the recovery of electrolyte plating chemicals from rinse baths in electroplating apparatus and methods and will be described with particular reference thereto. It will be appreciated, however, that the invention has broader applications such as returning chemicals to a primary treatment or processing tank from down line processing and rinse tanks.

Commonly, workpieces or parts are electroplated or treated in an electroplating or treatment tank and, subsequently, rinsed in a three stage cascading counterflow rinse system. The plating tank contains an electrolyte or plating solution, an anode of the metal to be plated, a cathode structure which is adapted to be electrically connected with received workpieces, and a heater for maintaining the plating solution at an elevated temperature. The water in the plating solution, particularly at the elevated temperature, evaporates at a substantial rate. To maintain the level of the plating solution substantially constant, a mechanical level detector, such as a float, is disposed in the plating tank for operating a water valve to add water when the level drops.

The three stage cascading counterflow rinse system includes first, second, and third interconnected rinse tanks in which water cascades from one rinse tank to the next. The workpieces from the electroplating tank are submersed successively in the first, the second, and the third rinse tanks to rinse the plating solution. The rinse water is introduced into the third rinse tank raising its fluid level and causing it to cascade through an overflow weir into the second rinse tank. This raises the fluid level in the second tank causing it to cascade through another overflow weir into the first rinse tank. This raises the fluid level in the first tank causing it to overflow through a drain for disposal. This results in the first rinse tank having the highest concentration of plating solution and the last tank having the lowest concentration.

Allowing the first rinse tank to overflow into a drain discards a significant amount of the electroplating chemicals which is undesirable for both environmental and cost reasons. To cover the electrolyte from the first rinse tank, it has been suggested that another overflow weir be positioned to allow the rinse solution to cascade from the first rinse tank into the plating tank. A principal problem with this arrangement resides in matching the flow rate from the rinse tanks with the rate of evaporation from the plating tank. If the flow rate from the rinse tanks is too high, the plating tank becomes overfilled and overflows causing a loss of relatively large amounts of the plating chemicals. If the flow rate from the rise tank is too slow, the plating solution volume is reduced and the workpieces are not properly electroplated. To match the flow rate with the evaporation rate, it has been suggested that the mechanical level detector in the plating tank control the water flow into the third rinse tank. However, mechanical controls are subject to malfunction which causes overflowing or underfilling of the plating tank.

The problems are further complicated by manufacturing specifications which require a high degree of rinsing. To maintain the rinse solution in the third tank sufficiently dilute to meet high rinsing specifications, it is frequently necessary to add water faster than the evaporation rate. To insure adequate rinsing, it has been suggested that the third rinse tank be isolated from the others and the mechanical level detector control the addition of fresh water directly to the second rinse tank. This not only has the inherent problems of mechanical controls, but also prevents any recovery of the plating chemicals from the third rinse tank.

The present invention contemplates a new and improved chemical recovery apparatus and method which overcomes all of the above-referenced problems and others. It accurately matches the rinse solution flow rate with the evaporation rate, allows high dilution of the final rinse tank, yet requires no mechanical controls.

SUMMARY OF THE INVENTION

In accordance with the present invention, there is provided treating apparatus comprising a treatment tank, at least first and final rinse tanks, fluid paths interconnecting the treatment tank, the first rinse tank and the final rinse tank, and level maintaining means for maintaining the fluid level in the treatment and rinse tanks at a predetermined level. The treatment tank is adapted to be filled to the predetermined level with a treating solution in which the workpieces are submersed for treatment. The fluid level of the treating solution is diminished by evaporation. The first and final rinse tanks are adapted to be filled to the predetermined level with rinsing solution in which the workpieces are submersed to rinse the treating solution. A first of the fluid paths interconnects the treatment tank and the first rinse tank such that solution flows by gravity from the first rinse tank to the treatment tank to replace evaporated treating solution. A second fluid path is in fluid connection with the first and final rinse tanks such that rinse solution flows by gravity from the final rinse tank to the first rinse tank.

A principal advantage of the present invention is that it effectively and reliably recovers chemicals from rinse tanks.

Another advantage of the present invention is that it allows the final rinse tank to be highly diluted.

Yet another advantage of the present invention is that it requires no mechanical controls.

Still further advantages of the present invention will become apparent to others upon reading and understanding the following detailed description of the preferred embodiment.

BRIEF DESCRIPTION OF THE FIGURES

The invention may take form in various steps or parts or arrangements of steps and parts, a preferred embodiment of which is described in the specification and illustrated in the drawings. The drawings, which are only for purposes of illustrating the preferred embodiment and are not to be taken as limiting the invention, show.

DETAILED DESCRIPTION OF THE PREFERRED EMBODIMENT

Figure 1:
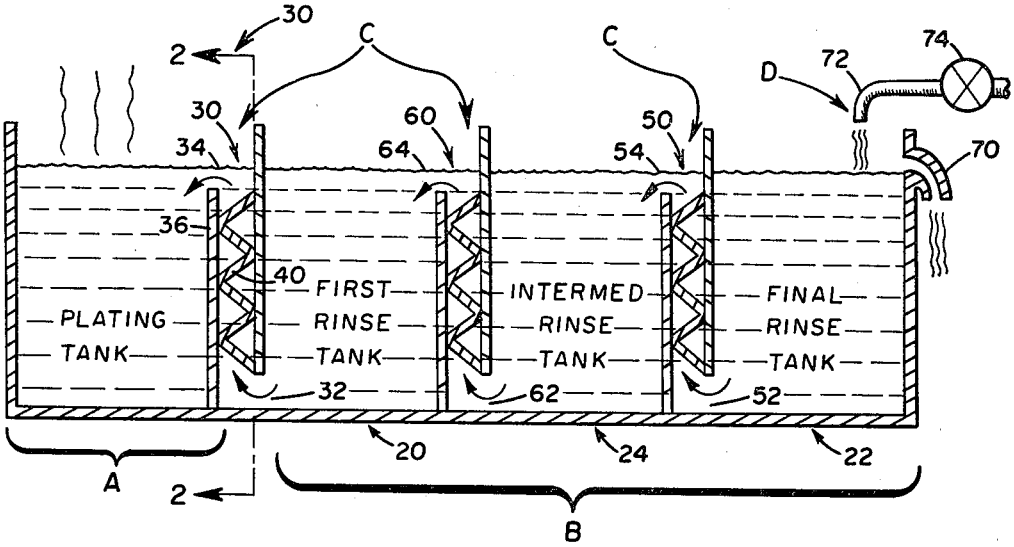
FIG. 1 is a diagrammatic, sectional illustration of an evaporation driven counterflow rinse apparatus in accordance with the present invention.

With reference to FIG. 1, the apparatus includes one or more plating or treatment tanks A which are adapted to be filled with a plating or treating solution and a plurality of rinse tanks B which are adapted to be filled with a rinse solution. A plurality of fluid paths C extend between the rinse and plating tanks to maintain the plating and rinse solutions at the same level. A fluid level maintaining means D maintains the solution level in one of the rinse tanks at a predetermined level. Because the fluid paths C maintain the plating and rinse tanks at the same level, the fluid level maintaining means D maintains all the tanks at the predetermined level.

The plating tank A contains electrodes, specifically an anode of the metal to be plated and a cathode means which is adapted for electrical interconnection with the workpieces to be plated, and a heating means for maintaining the plating tank and its contents at an elevated temperature in the range of 180° to 220° F. The plating solution (electrolyte) includes ions of the metal to be plated, plating bath additives (chemicals) and water. The elevated temperature of the plating solution causes water to evaporate at a substantial rate. The evaporation varies with temperature, relative air movement over the tank, concentration of the plating solution, atmospheric conditions including temperature and relative humidity of the ambient air, and the like.

The plurality of rinse tanks B includes a first rinse tank 20 and a final rinse tank 22. Optionally, an intermediate rinse tank 24 or a plurality of intermediate rinse tanks may be disposed between the first and final rinse tanks. After removal from the plating tank A, the workpieces are sequentially submersed in the first, intermediate, and final rinse tanks to rinse plating solution or drag out which adheres to them by surface tension and the like. Each of the rinse tanks contain rinsing solution which includes water and plating chemicals which have been rinsed from preceding workpieces. Because the first rinse tank 20 rinses undiluted plating solution from the workpieces, the rinsing solution which it contains has a lower concentration of plating chemicals than the plating solution but a higher concentration of plating chemicals than the rinsing solution in the other rinse tanks. Because the intermediate rinse tank 24 rinses workpieces that have already been rinsed once, the rinsing solution which it contains has a lower concentration of plating chemicals, i.e., is more dilute. Similarly, the rinsing solution in the final rinse tank 22 has the lowest concentration of plating chemicals, i.e., is the most dilute.

To replace the water lost by evaporation from the plating solution and to return plating chemicals carried from the plating tank by the workpieces, a first fluid path 30 connects the plating and first rinse tanks. The rinsing solution flows by gravity from the first rinse tank into the plating tank. The first flow path 30 is sufficiently elongated or tortuous that any migration of plating chemical from the more concentrated plating solution to the lower concentration solution in the first rinse tank is offset by the evaporation replacing flow of fluid from the first rinse tank. This prevents the flow path 30 from diluting the plating solution in the plating tank and from increasing the plating chemical concentration in the first rinse tank. The first flow path 30 includes an overflow weir having an inlet opening 32 in fluid communication with the first rinse tank 20 and an outlet opening 34 in fluid communication with the plating tank A. The inlet opening 32 of the weir is disposed below the predetermined level near the bottom of the tank. When evaporation causes the fluid level in the plating tank A to drop below the fluid level in the first rinse tank 20, the difference in fluid levels under gravitational force causes solution to flow from the inlet opening 32 to the outlet opening 34 until the fluid levels are substantially the same. Because the evaporation from the plating tank is continuous, the flow from the first rinse tank to the plating tank is substantially continuous.

Figure 2:
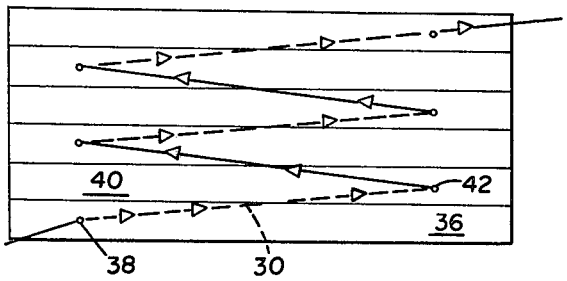
FIG. 2 is a sectional view through section line 2—2 of FIG. 1.

With continued reference to FIG. 1 and particular reference to FIG. 2, a plurality of baffles are disposed across the weir. A bottom baffle 36 having an aperture 38 towards one end is connected with the front, back, and side walls of the weir so that fluid flow passing through the weir is limited to fluid flow through the first aperture 38. A second baffle 40 with a small aperture 42 disposed in one end thereof is connected with the front, back, and side walls of the weir such that all fluid flow through the weir much pass through aperture 42. Similarly, additional baffles each with a small aperture are connected with the front, back, and side walls of the weir with their apertures at alternating ends causing the fluid to flow through the weir in a substantially S-shaped path. The baffles with their apertures define the first flow path 30 and render it sufficiently elongated and tortuous that migration of plating chemicals from the plating tank to the rinse tank is substantially eliminated. In the preferred embodiment, there are six baffles each disposed at generally 45° from horizontal and generally 90° relative to adjoining baffles. Alternately, the baffles or layers of screen may be horizontally disposed, parallel disposed, or disposed in other relations to define an elongated or tortuous path. As yet another alternative, the first flow path 30 may include a baffle-free elongated hose or tube.

Solution lost by the first rinse tank 20 in refilling the plating tank is replaced with solution from the final rinse tank 22 and the optional intermediate rinse tank 24, if present. A second fluid path 50 has an inlet opening 52 in the final rinse tank 22 below the predetermined level and a fluid outlet opening in fluid communication with the first rinse tank 20. If there are no intermediate rinse tanks, the outlet opening is in the first rinse tank. If there are one or more intermediate rinse tanks between the first and final rinse tanks, the intermediate rinse tanks and intermediate fluid paths provide the fluid communication between the outlet opening 54 and the first fluid tank 20. The second fluid path 50 is sufficiently elongated and tortuous that the migration of plating chemicals from the more concentrated rinse solution to the least concentrated rinse solution in the final rinse tank 22 is inhibited. The second flow path 50 includes a second weir and plurality of second baffles of the same construction as the first fluid path 30. The plurality of second baffles with small apertures alternately disposed therein are arranged in the second weir 50 as described above in conjunction with the first baffles. The arrangement of the second baffles is such that the evaporation replacing flow rate of solution toward the first rinse tank exceeds the migration rate of plating chemicals from the more concentrated solution to the least concentrated solution of the first rinse tank.

With continued reference to FIG. 1, the intermediate rinse tank 24 and a third or intermediate fluid path 60 connect the first and final rinse tanks. The third fluid path includes a third weir with a plurality of third baffles of substantially the same construction as the first and second weirs 30 and 50. The third weir has an inlet opening 62 disposed in the intermediate rinse tank 24 below the predetermined level and an outlet opening 64 into the first rinse tank 20. The arrangement of baffles and apertures defines the third path such that it is sufficiently elongated or tortuous to inhibit the migration of plating chemicals from the more concentrated first rinse tank solution to the less concentrated intermediate rinse tank solution. Any such migration from higher to lower concentration solutions is offset by the evaporation replacing flow.

The level maintaining means D operates in conjunction with the final rinse tank 22. The level maintaining means D includes an overflow outlet 70 which is disposed in the side wall of the final rinse tank at the predetermined level and a water or rinsing solution inlet 72 which is disposed to introduce fresh water or rinsing solution into the final rinse tank. The inlet 72 provides a continuous flow of water at a rate which exceeds the expected evaporation rate. Any water which would tend to raise the fluid level in final rinse tank above the predetermined level, flows out the overflow outlet 70. This maintains the final rinse tank 22 at the predetermined level. The inlet 72 may be connected with the city water system or other source of water which has a lower concentration of plating chemicals than the final rinse tank.

As water evaporates from the plating tank its fluid level tends to drop below the predetermined level. Under the influence of gravity, solution flows from the first rinse tank 20 through the first fluid path 30 into the plating tank to replace water lost to evaporation. This not only replaces evaporated water, but also returns plating chemicals recovered in the rinse tanks. The evaporation replacing flow tends to drop the fluid level of the first tank below the predetermined level. Under the influence of gravity, a like evaporation replacing flow of rinse water and recovered plating chemicals flows from the intermediate rinse tank through the third fluid path 60 to the first rinse tank. This tends to drop the fluid level of the intermediate rinse tank below the predetermined level. Under the influence of gravity, a like evaporation replacing flow of rinse water and recovered plating chemicals flows from the final rinse tank 22 through the second fluid path 50 into the intermediate tank. The rinse water inlet 72 maintains the fluid level of the final rinse tank at the predetermined level. Part of the plating chemicals recovered in the final rinse tank are returned in the evaporation replacing flow and some are lost through the overflow 70. However, because most of the plating chemicals are recovered in the first and intermediate rinse tanks, a relatively small amount are lost through the overflow 70. In this manner, a substantially continuous. gravity driven, evaporation replacing flow which carries recovered plating chemicals, flows through the rinse tanks to the plating tank.

The flow rate of the water inlet 72 is adjusted manually by a flow regulating valve 74 to select the plating chemical concentration or dilution of the final rinse tank. The more thoroughly the workpieces are to be rinsed, the greater the inlet water flow which is selected by adjusting valve 74. The greater the flow of fresh water into the final rinse tank, the more dilute the rinse solution therein becomes. If the manufacturing specifications permit, the inlet water flow rate is reduced, so that less plating solution is lost through overflow outlet 70. The inlet water flow rate, however, should always meet or exceed the expected evaporation rate. Preferably, the inlet water flow rate should exceed the expected evaporation rate by at least 50% to provide a margin of safety against lowering the level of plating solution in the plating tank below the predetermined level, if the evaporation is greater than expected.

In use, the workpieces or parts to be plated are disposed in a wire basket or otherwise connected with the cathode and submersed in the plating tank solution. As is conventional, an electric current through the plating solution from the anode to the cathode deposits a layer of metal on workpieces. When a desired thickness of metal has been deposited, the current is stopped and the basket is withdrawn from the plating tank allowing the plating solution to flow from the workpieces back into the plating tank. However, surface tension and other physical factors causes some of the plating solution, known as drag-out, to adhere to the parts in the basket. The basket of parts is then submersed in the first rinse tank to rinse this plating solution from the parts in the basket. After rinsing several baskets of workpieces, a relatively high concentration of plating solution develops in the first rinse tank. When the basket of workpieces is withdrawn from the first rinse tank, the diluted plating solution adheres to them. To remove the plating solution more completely, the workpieces are submersed in the intermediate rinse tank 24. When the basket of workpieces is withdrawn from the intermediate rinse tank, the more diluted plating solution adheres to them. To rinse the parts still more completely, the parts are submersed in the final rinse tank 22. Additional rinsing may be obtained by submersing the parts in a supplemental rinse tank. The completeness of rinsing varies inversely with the concentration of plating chemicals in the final rinse tank. After the workpieces are withdrawn from the final rinse tank, they may undergo further treating or manufacturing operations which may include further rinsing or cleaning operations.

When the basket of workpieces is submersed in the solution in the plating tank or one of the rinse tanks, the workpieces and basket displace some of the solution raising the solution level in that tank. This elevated fluid level tends to cause a fluid flow from the tank in which the basket and workpieces are submersed toward the adjoining tanks. Analagously, withdrawing the basket and workpieces lowers the fluid level, drawing solution from the adjoining tanks. Further, the submersion and withdrawal of the basket and workpieces tends to cause a turbulence. To inhibit concentrated solutions from flowing into tanks with less concentrated solutions, each fluid path has a volume which is greater than the volume of fluid displaced by the basket and workpieces. This causes the displaced solution to be received totally within the flow path and not discharged into a more dilute tank. As the basket of parts is withdrawn from the tank, the displaced solution is again withdrawn from the adjacent fluid paths. The fluid paths are sufficiently tortuous that the submersion and withdrawn turbulence is dissipated thus inhibiting the mixing of solutions in adjacent tanks.

Although described in conjunction with electroplating, it will be appreciated that the invention finds utility in recovering chemicals in conjunction with other chemical treatment processes in which unspent chemicals are rinsed from workpieces into rinse tanks. The invention has been described with reference to the preferred embodiment. Obviously, modifications and alterations will occur to others upon reading and understanding this specification. It is intended to include all such modifications and alterations which come within the scope of the appended claims or the equivalents thereof.

Having thus described our preferred embodiment, we now claim:

1. An electroplating apparatus comprising:

a plating tank for receiving a plating solution including plating chemicals and water to a predetermined fluid level in which a selected number of workpieces on a supporting structure are submersed and plated, the plating solution level being diminished by evaporation;

a first rinse tank for receiving rinsing solution to said predetermined level, the first rinse tank being disposed sufficiently adjacent the plating tank to enable plated workpieces to be submersed in the first rinse tank solution to rinse the plating solution from the plated workpieces, whereby the rinsing solution in the first rinse tank includes water and the plating chemicals rinsed from preceding workpieces;

a first elongated fluid path interconnecting the plating tank and the first rinsing tank, the first fluid path being disposed at or below said predetermined level such that solution flows by gravity from the first rinsing tank to the plating tank to replace evaporated plating solution, whereby plating chemicals are returned to the plating tank, with said first fluid path including a plurality of baffles therein to prevent fluid from flowing directly therethrough;

a final rinse tank for receiving rinsing solution to said predetermined level, the final rinse tank being disposed sufficiently adjacent the first rinse tank to enable the rinsed workpieces to be submersed in the final rinse tank solution to rinse the plated workpieces further, whereby the rinsing solution in the final rinse tank includes water and the plating chemicals rinsed from preceding workpieces;

a second elongated fluid path in fluid connection with the first and final rinse tanks, the second fluid path being disposed at or below said predetermined level such that solution flows by gravity from the final rinse tank to the first rinse tank with said second fluid path including a plurality of baffles therein to prevent fluid from flowing directly therethrough; and level maintaining means operatively connected with the final rinse tank for maintaining the rinsing solution in the final rinse tank at said predetermined level, whereby the solutions in the first rinse tank, final rinse tank and the plating tank are maintained at said predetermined level and plating chemicals are returned from the final rinse tank to the first rinse tank and from the first rinse tank to the plating tank.

2. The apparatus as set forth in claim 1 wherein the first and second fluid paths are tortuous.

3. The apparatus as set forth in claim 1 wherein the first fluid path includes a first weir which interconnects the first rinse tank with the plating tank and a plurality of first baffles disposed in the first weir.

4. The apparatus as set forth in claim 3 wherein the first weir has an inlet in the first rinse tank below the predetermined level and an outlet in the plating tank.

5. The apparatus as set forth in claim 4 wherein the first baffles are disposed generally across the first weir, each first baffle defining a fluid passage therepast.

6. The apparatus as set forth in claim 5 wherein the fluid passage defined by each first baffle is an aperture therethrough.

7. The apparatus as set forth in claim 5 wherein the fluid passages defined by adjacent first baffles are disposed adjacent opposite ends.

8. The apparatus as set forth in claim 5 wherein each first baffle connects along a horizontal edge with at least one other first baffle.

9. The apparatus as set forth in claim 8 wherein the first baffles are disposed generally normal to each other.

10. The apparatus as set forth in claim 4 wherein the second fluid path includes a second weir which has an inlet in the final rinse tank below the predetermined level and an outlet in fluid communication with the first rinse tank and a plurality of second baffles disposed in the second weir.

11. The apparatus as set forth in claim 10 further including an intermediate rinse tank for receiving rinsing solution to said predetermined level, the intermediate rinse tank being disposed sufficiently adjacent the first and final rinse tanks to enable plated workpieces to be submersed in the intermediate rinse tank between being submersed in the first and final rinse tanks, a third weir having an inlet opening in the intermediate rinse tank below the predetermined level and an outlet opening in the first rinse tank, and a plurality of third baffles disposed in the third weir, and wherein the second weir outlet is disposed in the intermediate rinse tank.

12. The apparatus as set forth in claim 1 wherein the level maintaining means includes an overflow outlet disposed on said final rinse tank substantially at a predetermined level and a supply means which supplies water to the final rinse tank at a rate greater than the evaporation rate, whereby the rinse solution in the final rinse tank flows from the final rinse tank to the first rinse tank and the plating tank to maintain them at said predetermined level and any excess rinse solution flows through the overflow outlet.

13. A method of electroplating with an electroplating apparatus which includes a plating tank filled to a predetermined level with a plating solution including plating chemicals and water, a first rinse tank filled to said predetermined level with a rinsing solution including water and a dilute concentration of plating chemicals, a first elongated fluid path interconnecting the plating and first rinse tank below the predetermined level, a final rinse tank filled to said predetermined level with a rinsing solution including water and a more dilute concentration of plating chemicals, a second elongated fluid path in fluid communication with the first and final rinse tanks below the predetermined level, an overflow outlet disposed in the final rinse tank substantially at said predetermined level, and a water inlet for supplying water to the final rinse tank, the method comprising:

selecting a workpiece to be plated and the supporting structure therefor so that when said workpiece and said supporting structure are submerged in said plating tank the volume of fluid displaced is less than the volume of said first elongated fluid path;

running water from the water inlet into the final rinse tank at a rate greater than the rate of evaporation of water from the plating tank and allowing any excess water to flow through the overflow outlet, whereby the level of fluid in the tanks is maintained substantially at said predetermined level;

submersing said workpiece in the plating tank and electroplating the same;

withdrawing the workpiece from the plating tank and submersing it in the first rinse tank;

withdrawing the workpiece from the first rinse tank and submersing it in the final rinse tank; and withdrawing the workpiece from the final rinse tank.

* * * * *